US010048038B1

(12) United States Patent
Darlington

(10) Patent No.: US 10,048,038 B1
(45) Date of Patent: Aug. 14, 2018

(54) CABLE SLIDER FOR ARCHERY BOW

(71) Applicant: Rex F. Darlington, Whittemore, MI (US)

(72) Inventor: Rex F. Darlington, Whittemore, MI (US)

( * ) Notice: Subject to any disclaimer, the term of this patent is extended or adjusted under 35 U.S.C. 154(b) by 0 days.

(21) Appl. No.: 15/818,019

(22) Filed: Nov. 20, 2017

Related U.S. Application Data

(60) Provisional application No. 62/425,103, filed on Nov. 22, 2016.

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01)

(58) Field of Classification Search
CPC ..... F41B 5/10
See application file for complete search history.

(56) References Cited

U.S. PATENT DOCUMENTS 5,553,600 A * 9/1996 Miller ..... F41B 5/10 124/25.6
5,983,880 A * 11/1999 Saunders ..... F41B 5/10 124/25.6
8,813,737 B2 * 8/2014 Langley ..... F41B 5/14 124/25.6

OTHER PUBLICATIONS http://www.lancasterarchery.com/bow-accessories/cable-guards-1.html.

* cited by examiner

*Primary Examiner* — John Ricci
(74) *Attorney, Agent, or Firm* — Reising Ethington, P.C.

(57) ABSTRACT

An archery bow cable slider includes a forward wall extending away from a base wall, a bifurcated wall extending away from the base wall including a rearward wall extending away from the base wall and an intermediate wall extending away from the rearward wall, and a throughbore extending through free ends of the forward, rearward, and intermediate walls. The base, forward, rearward, and intermediate walls establish a first slot having a laterally extending portion and an axially extending portion that extends substantially perpendicular to the laterally extending portion, and the rearward and intermediate walls establish a second slot that at least partially axially overlaps the first slot.

24 Claims, 5 Drawing Sheets

Figure 4
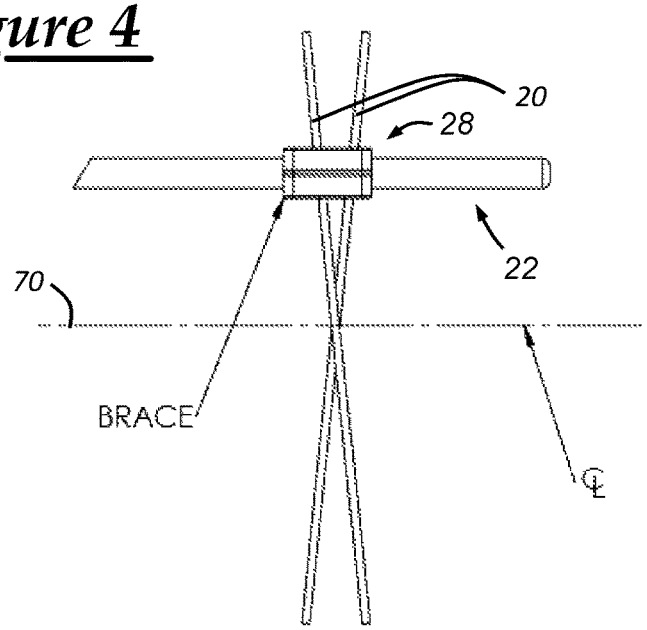
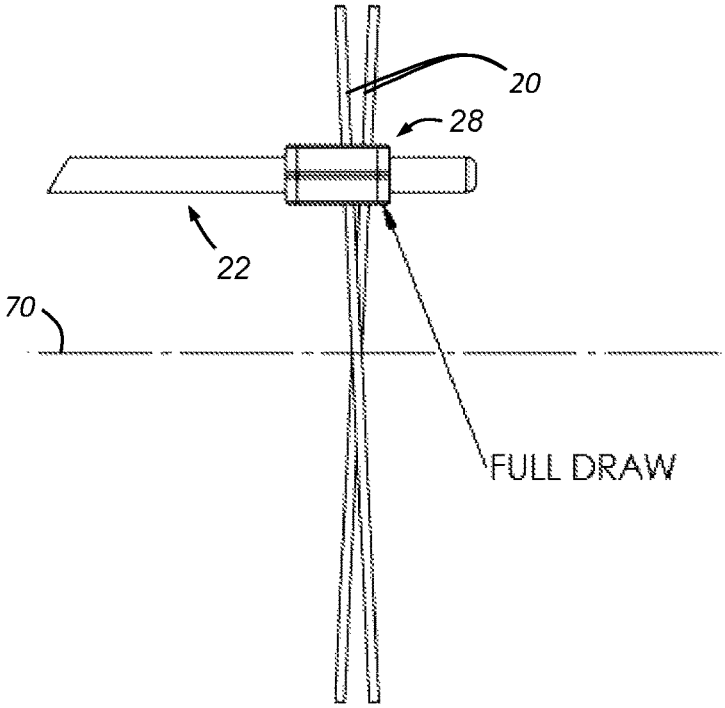
Figure 5

*Figure 6*
*Prior Art*
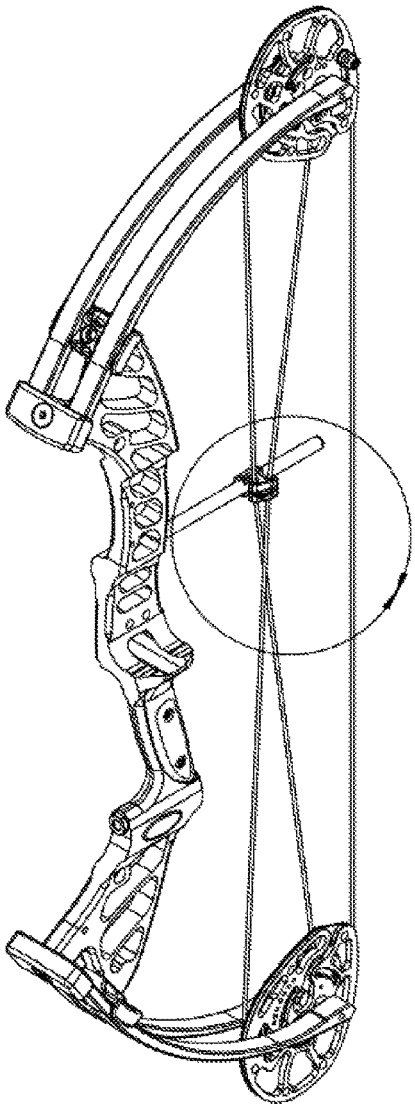
*Figure 7*
*Prior Art*
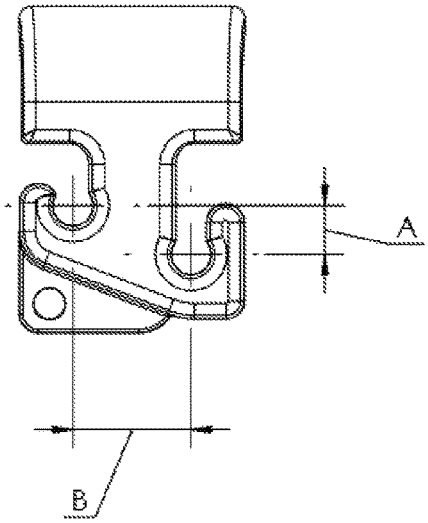
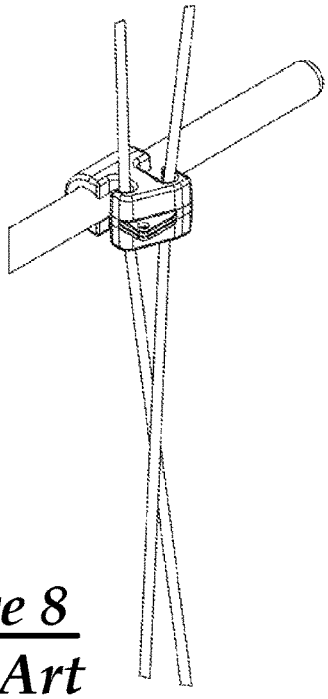
*Figure 8*
*Prior Art*

*Figure 9*
*Prior Art*
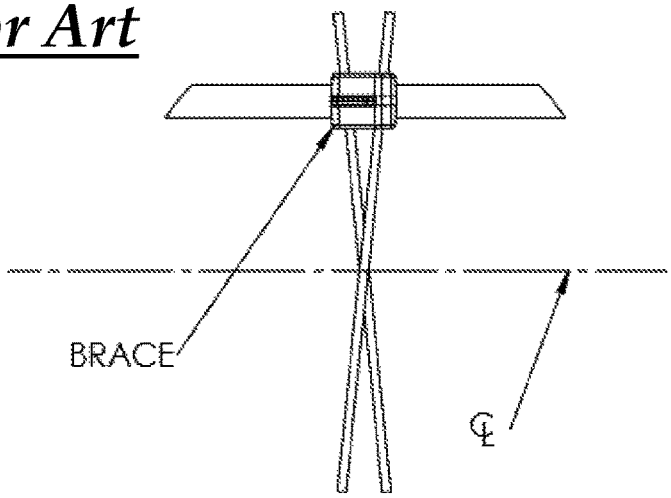
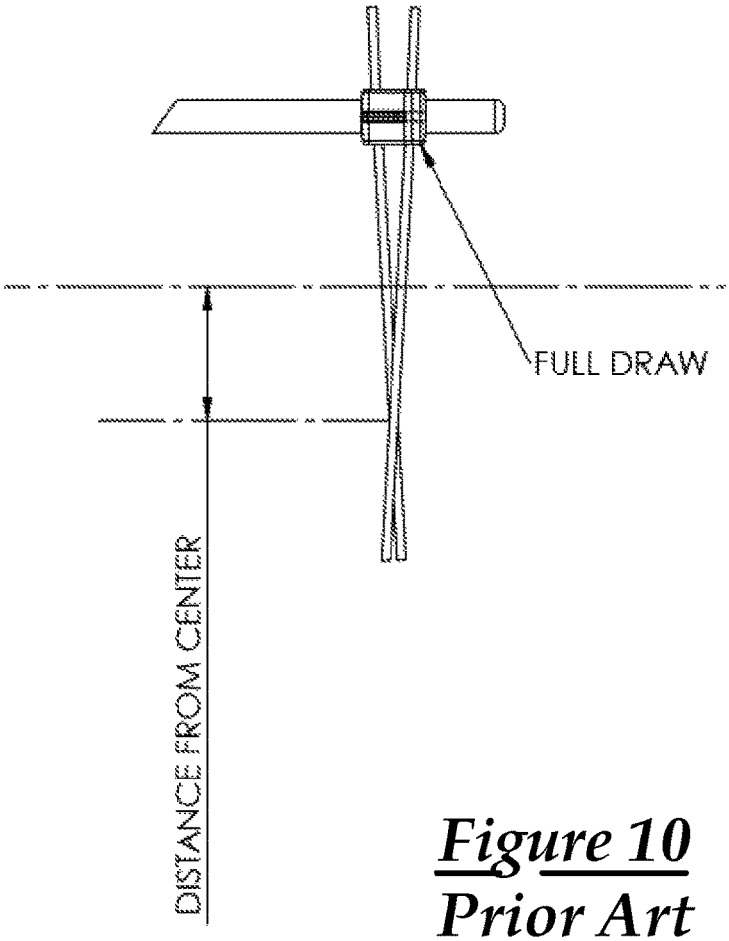
*Figure 10*
*Prior Art*

CABLE SLIDER FOR ARCHERY BOW

TECHNICAL FIELD

This disclosure relates generally to compound archery bows and, more particularly, to cable sliders for compound archery bows.

BACKGROUND

A typical compound archery bow (as illustrated in prior art FIG. 6) usually includes a riser having opposite ends and a handle therebetween, flexible limbs extending from the ends of the riser and having free ends, and a bowstring coupled to the free ends of the limbs. One type of compound archery bow typically also includes pulleys at the ends of the limbs. The bowstring is typically coupled to the pulleys around an outer circumference thereof, and power cables are typically coupled around other circumferential portions of the pulleys to control bowstring draw characteristics. The typical compound archery bow also usually includes a cable guard or cable guide rod extending rearwardly from a fixed end coupled to the riser to a free end, and a cable slider slidably carried on the rod and adapted to guide the power cables back and forth along the rod as the bow is drawn and released. One-piece sliders (as illustrated in prior art FIG. 7) are known for holding the power cables in fixed positions so as to separated from one another and spaced apart along a longitudinal axis of the rod. More recently, multi-piece sliders are known for restraining the power cables between limits while preventing the power cables from contacting one another as they slide back and forth.

With reference to FIG. 7 and FIG. 8 illustrating typical prior art, a unitary cable slider includes a mounting portion having a throughbore for axially slidable mounting on a cable guide rod, and a cable spacer portion extending laterally from the mounting portion. The cable spacer portion includes a central wall and forward and rearward cable slots on either axial side of the central wall. Each cable slot terminates in a semi-cylindrical end. A lateral distance A between the ends keeps the cables spaced apart in a lateral direction, and an axial distance B between the ends fixedly maintains the cables spaced apart in an axial direction.

Prior art FIG. 9 and FIG. 10 demonstrate that, when the bow is at brace (i.e., not drawn), the cables cross at a centerline of the bow, and that, at full draw of the bow, the cables cross at a location spaced vertically from the bow centerline when the bow is held in a vertical orientation. In other words, the location at which the cables cross moves (e.g., 20-45 mm) over the draw cycle of the bow. By fixing the cables in their spaced apart condition, the cable slider induces the dislocation of the cable crossing away from the bow centerline and, thus, affects the cam timing or synchronization.

BRIEF DESCRIPTION OF THE DRAWINGS

The accompanying drawing figures include an illustrative embodiment of a prior art archery bow cable slider alone, and in combination with a compound archery bow.

The accompanying drawing figures also include an illustrative embodiment of a presently disclosed archery bow cable slider alone, and in combination with a compound archery bow.

FIG. 4 is an enlarged view of a portion of the bow of FIG. 1, illustrating the cable slider on a cable guide with the cables in a brace position;

FIG. 5 is an enlarged view similar to that of FIG. 4, but illustrating the cable slider on the cable guide with the cables in a full draw position;

FIG. 6 is an illustrative perspective view of a compound bow utilizing a prior art cable slider;

FIG. 7 is a top plan view of the prior art cable slider from FIG. 6;

FIG. 8 is an enlarged view of a portion of the bow of FIG. 6, illustrating the prior art cable slider from FIG. 6;

FIG. 9 is an enlarged view of a portion of the bow of FIG. 6, illustrating the prior art cable slider on a cable guide with the cables in a brace position;

FIG. 10 is an enlarged view similar to that of FIG. 9, but illustrating the prior art cable slider on the cable guide with the cables in a full draw position;

DETAILED DESCRIPTION

In general, an archery bow 10 will be described using one or more examples of illustrative embodiments of a vertical compound bow 10. However, it will be appreciated as the description proceeds that the inventive subject matter may be embodied in a crossbow.

Figure 1:
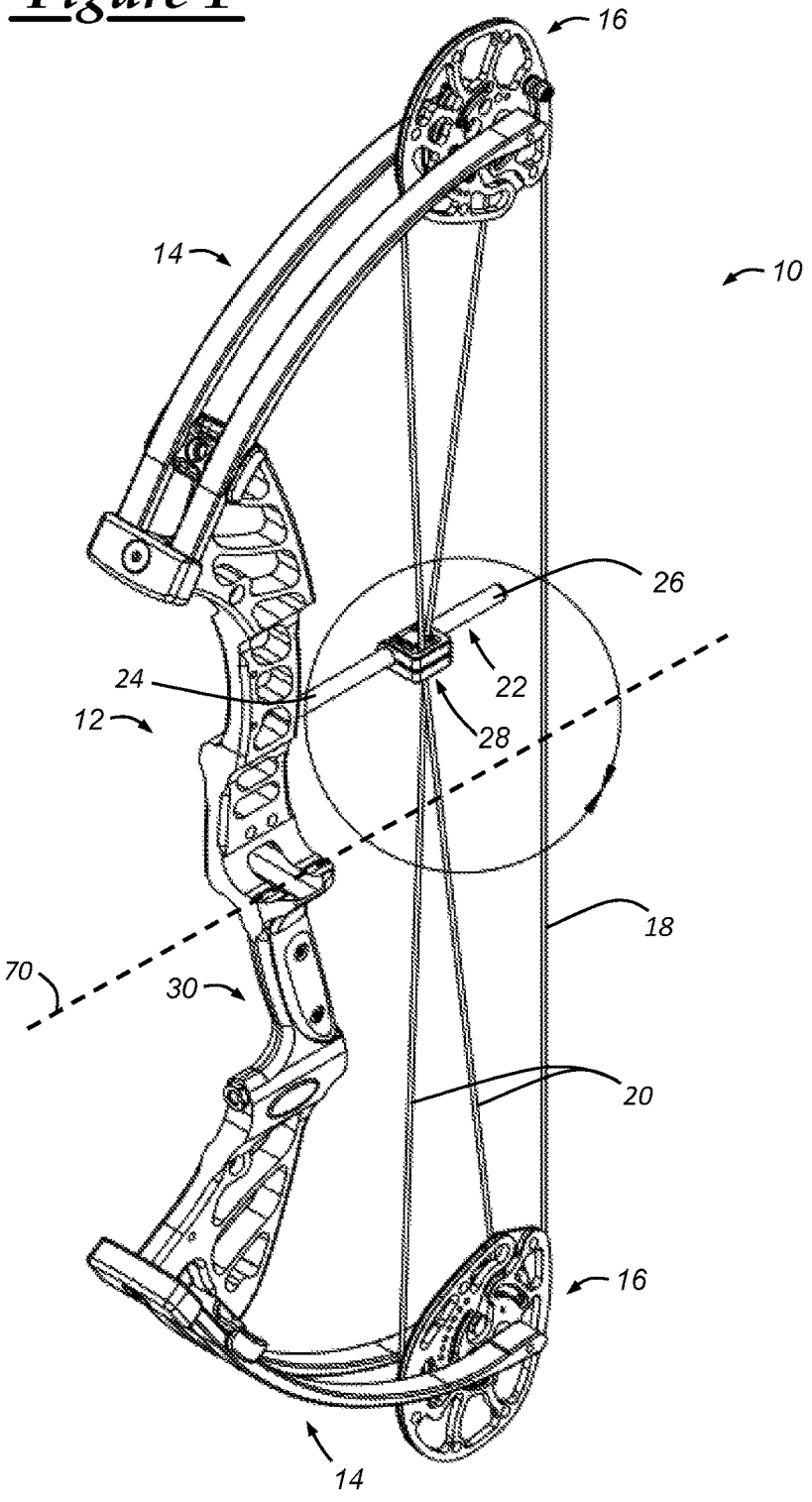
FIG. 1 is an illustrative perspective view of a compound bow utilizing a cable slider.

Referring specifically to the drawings, FIG. 1 shows an illustrative embodiment of a vertical compound bow 10 that includes a riser 12 generally at a front of the bow 10, upper and lower or limbs 14 extending from the riser 12, and pulleys 16 carried by the limbs 14. The bow 10 also includes a bowstring 18 generally at a rear of the bow 10 and coupled to the pulleys 16, and first and second cables 20 coupled to the pulleys 16. The bow 10 further includes a cable guide 22 extending in a rearward direction from a fixed end 24 at the riser 12 toward a free end 26, and a cable slider 28 carried by the cable guide 22 and carrying the cables 20.

The riser 12 is also known as a bow body or block and includes opposite ends that may be coupled to the limbs 14, a handle 30 between the ends for gripping by an archer, and a central portion. In a crossbow embodiment, a stock may be coupled to the riser 12 in any suitable manner.

The limbs 14 may be coupled to the riser 12 by integral connection, separate fasteners, or in any other suitable manner. The limbs 14 may include flexible beams cantilevered from the riser 12 at fixed ends and extending to free ends. The limbs 14 may include only beams themselves or may include additional hardware to facilitate coupling to the riser 12. For example, the hardware may include bracketry, fasteners, welds, or any other suitable expedients for coupling to the riser 12.

The pulleys 16 are rotatably coupled to the free ends of the limbs 14 in any suitable manner. The pulleys 16 may include circular wheels, cams, or any combination thereof.

The bowstring 18 is coupled to the pulleys 16 in any suitable manner. The bowstring 18 is also known as a bowstring cable and, in any event, is configured for pulling by an archer to draw the bow 10.

The power cables 20 are coupled to the pulleys 16 in any suitable manner, and are configured to increase the propulsion power of the bow 10.

The cable guide 22 is coupled to the riser 12 and may include a fixed end 24 at the riser 12 and a free end 26 spaced rearwardly of the riser 12. The cable guide 22 may be straight, or non-linear as shown, and may be a cylindrical rod.

Figure 2:
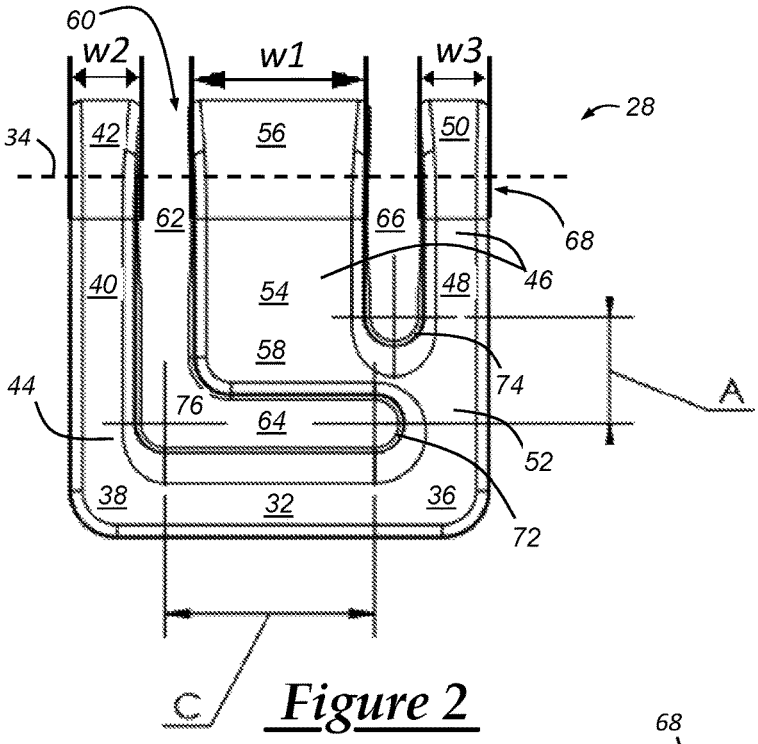
FIG. 2 is a top plan view of an embodiment of the cable slider from FIG. 1.

The cable slider 28 is axially slidably carried by the cable guide 22 so as to slide back and forth as the bow 10 is drawn and released. As shown in FIG. 2, the cable slider 28 may include a trifurcated unitary body including a base wall 32 that may extend substantially parallel to the direction of an axis 34 and may have a forward end 36 and a rearward end 38. The cable slider 28 also may include a forward wall 40 extending in a direction transversely away from the base wall 32 from a forward fixed end 42 to a forward free end 44, so as to establish an L-shape. The cable slider 28 further may include a bifurcated wall 46 extending away from the base wall 32 to establish a y-shape. The bifurcated wall 46 may include a rearward wall 48 that may extend in a direction transversely away from the base wall 32 from a rearward fixed end 50 to a rearward free end 52 and spaced axially apart from the forward wall 40. The bifurcated wall 46 also may include an intermediate wall 54 that may extend from a portion of the rearward wall 48 at a location spaced transversely away from the base wall 32, and may extend in a direction transversely away from the base wall 32 from an intermediate fixed end 56 to an intermediate free end 58, and may be spaced axially apart from the forward wall 40 and rearward wall 48. The width (w1) of the intermediate wall 54 may be wider in an axial direction than each of the widths (w2, w3) of the forward and rearward walls 40, 48, and may be wider in an axial direction than both of the forward and rearward walls 40, 48 combined.

The base, forward, rearward, and intermediate walls 32, 40, 48, 54 may establish an L-shaped slot 60 having a laterally extending portion 62 and an axially extending portion 64 that may extend in a direction that is substantially parallel to the axis 34 and substantially perpendicular to the laterally extending portion 62. The rearward and intermediate walls 48, 54 may establish a straight slot 66 that, as illustrated, at least partially axially overlaps the axially extending portion 64 of the L-shaped slot 60, and that may be substantially parallel to the laterally extending portion 62. As used herein, the phrases "substantially perpendicular" and/or "substantially parallel" include plus or minus five angular degrees of perpendicular and/or parallel. In other embodiments, the axially extending portion 64 of the L-shaped slot 60 may completely axially overlap the straight slot 66 or even may extend axially beyond the straight slot 66.

The cable slider 28 also includes a throughbore 68 extending through the free ends 44, 52, 58 of the forward, rearward, and intermediate walls 40, 48, 54, for slidable mounting on the cable guide 22.

Figure 3:
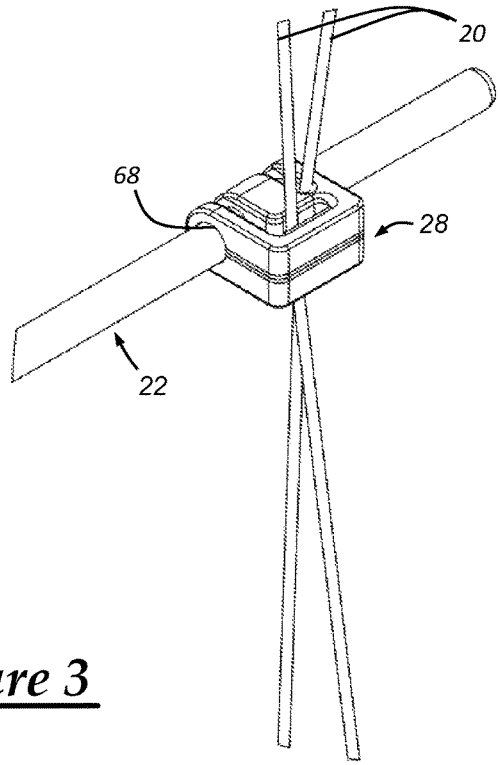
FIG. 3 is an enlarged view of a portion of the bow of FIG. 1, illustrating the cable slider from FIG. 1.

As shown in FIG. 3, the cable slider 28 is slidably carried on the cable guide 22, wherein a first one of the power cables 20 is carried in the L-shaped slot 60 and a second one of the power cables 20 is carried in the straight slot 66 such that the power cables 20 are separated from one another by a portion of the intermediate wall 54 and such that the power cables 20 may cross in a location axially aligned with a centerline 70 of the bow 10.

As shown in FIG. 2 and FIG. 3, A lateral distance A between ends of the slots 72, 74 keeps the cables 20 spaced apart in a lateral direction, and an axial distance C between the end 72 of the L-shaped slot 60 and the bend 76 of the L-shaped slot 60 allows the cable carried therein to traverse back and forth along the slot 60 in an axial direction.

FIG. 4 and FIG. 5 demonstrate that, ideally, when the bow 10 is at brace (i.e., not drawn), the cables 20 cross at a centerline 70 of the bow 10, and that, at full draw of the bow 10, the cables still cross at the bow 10 centerline 70 when the bow 10 is held in a vertical orientation. However, if the cams are not mirror images or if the limbs 14 are not balanced evenly or the like, then the cables 20 may not cross precisely at the centerline 70 of the bow 10, but preferably will cross at about the same point throughout the draw cycle. More specifically, the location at which the cables 20 cross remains substantially the same (moves 0-10 mm, including all ranges, sub-ranges, and values therebetween) over the draw cycle of the bow 10.

By allowing at least one of the cables 20 to traverse its respective slot 60, 66 in an axial direction, the cable slider 28 prevents dislocation of the cable crossing away from the bow 10 centerline 70 and, thus, maintains good cam timing or synchronization.

By allowing the cables 20 to move and cross one another independently (without forced axial separation by the slider), the pulleys 16 are able to maintain proper cam timing or synchronization throughout a complete draw cycle of the bow 10. Accordingly, the power cables 20 may be maintained at a constant angle with respect to the pulleys 16 despite use of the cable slider 28. Prior unitary cable sliders forcibly separate the cables in an axial direction, such that the cables do not cross at the centerline of the bow and do not maintain a constant angle with respect to the pulleys.

In general, the cable slider 28 can be manufactured according to techniques known to those skilled in the art, including molding, machining, stamping, drawing, and other bow 10 component manufacturing techniques. Likewise, any suitable materials can be used in making the components, such as metals, composites, polymeric materials, and other bow 10 component materials.

As used in this patent application, the terminology "for example," "for instance," "like," "such as," "comprising," "having," "including," and the like, when used with a listing of one or more elements, is open-ended, meaning that the listing does not exclude additional elements. Likewise, when preceding an element, the articles "a," "an," "the," and "said" mean that there are one or more of the elements. Moreover, directional words such as front, rear, top, bottom, upper, lower, radial, circumferential, axial, lateral, longitudinal, vertical, horizontal, transverse, and/or the like are employed by way of example and not limitation. Other terms are to be interpreted and construed in the broadest reasonable manner in accordance with their ordinary and customary meaning in the art, unless the terms are used in a context that requires a different interpretation.

Finally, the present disclosure is not a definitive presentation of an invention claimed in this patent application, but is merely a presentation of examples of illustrative embodiments of the claimed invention. More specifically, the present disclosure sets forth one or more examples that are not limitations on the scope of the claimed invention or on terminology used in the accompanying claims, except where terminology is expressly defined herein. And although the present disclosure sets forth a limited number of examples, many other examples may exist now or are yet to be discovered and, thus, it is neither intended nor possible to disclose all possible manifestations of the claimed invention. In fact, various equivalents will become apparent to artisans of ordinary skill in view of the present disclosure and will fall within the spirit and broad scope of the accompanying claims. Therefore, the claimed invention is not limited to the particular examples of illustrative embodiments disclosed herein but, instead, is defined by the accompanying claims.

The invention claimed is:

1. A cable slider for a compound archery bow, comprising:
a base wall;
a forward wall extending away from the base wall; and
a bifurcated wall extending away from the base wall including a rearward wall extending away from the base wall and an intermediate wall extending away from the rearward wall; and
a throughbore extending through free ends of the forward, rearward, and intermediate walls,
wherein the base, forward, rearward, and intermediate walls establish a first slot having a laterally extending portion and an axially extending portion that extends substantially perpendicular to the laterally extending portion, and the rearward and intermediate walls establish a second slot that at least partially axially overlaps the first slot.

2. The cable slider of claim 1, wherein the base wall extends along an axis.

3. The cable slider of claim 1, wherein the throughbore is complimentary to a cable guide.

4. The cable slider of claim 1, wherein the cable slider is molded, machined, stamped, or drawn.

5. The cable slider of claim 1, wherein the cable slider comprises a metal, a composite, or a polymeric material.

6. The cable slider of claim 1, wherein the bifurcated wall is in a y-shape.

7. The cable slider of claim 1, wherein the first slot is substantially L-shaped.

8. The archery bow of claim 7, wherein the cable slider is unitary and trifurcated.

9. The archery bow of claim 8, wherein the location is axially aligned with a centerline of the bow.

10. The archery bow of claim 8, wherein the cable slider is unitary and trifurcate.

11. The cable slider of claim 10, wherein the body comprises a throughbore penetrating through the body along the direction of the first axis, the throughbore being positioned near the free end.

12. The cable slider of claim 10, wherein the cable slider is molded, machined, stamped, or drawn.

13. The cable slider of claim 10, wherein the cable slider comprises a metal, a composite, or a polymeric material.

14. The archery bow of claim 13, wherein the cable slider is unitary and trifurcated.

15. An archery bow, comprising
a riser;
a pair of limbs extending away from the riser;
a pair of pulleys carried by the limbs;
a bowstring coupled to the pulleys;
a pair of power cables coupled to the pulleys;
a cable guide extending axially rearwardly away from the riser; and
the cable slider of claim 10 slidably carried on the cable guide, wherein a first one of the power cables is carried in the first slot and a second one of the power cables is carried in the second slot such that the power cables are separated from one another by a portion of the intermediate wall and the power cables cross in a location axially aligned with a centerline of the bow.

16. The cable slider of claim 10, wherein the cable slider is unitary and trifurcated.

17. An archery bow, comprising
a riser;
a pair of limbs extending away from the riser;
a pair of pulleys carried by the limbs;
a bowstring coupled to the pulleys;
a pair of power cables coupled to the pulleys;
a cable guide extending axially rearwardly away from the riser; and
the cable slider of claim 1 slidably carried on the cable guide, wherein a first one of the power cables is carried in the first slot and a second one of the power cables is carried in the second slot such that the power cables are separated from one another by a portion of the intermediate wall and the power cables cross in a location axially aligned with a centerline of the bow.

18. The cable slider of claim 1, wherein the cable slider is unitary and trifurcated.

19. An archery bow, comprising
a riser;
a pair of limbs extending away from the riser;
a pair of pulleys carried by the limbs;
a bowstring coupled to the pulleys;
a pair of power cables coupled to the pulleys;
a guide rod extending axially rearwardly away from the riser; and
the cable slider of claim 1 slidably carried on the guide rod, wherein a first one of the power cables is carried in the first slot and a second one of the power cables is carried in the second slot such that the power cables are separated from one another by a portion of the intermediate wall and the power cables cross in a location axially aligned with the centerline of the bow.

20. An archery bow, comprising
a riser;
a pair of limbs extending away from the riser;
a pair of pulleys carried by the limbs;
a bowstring coupled to the pulleys;
a pair of power cables coupled to the pulleys;
a cable guide extending axially rearwardly away from the riser; and
a cable slider including a forward wall and a bifurcate wall extending from a base wall, and slidably carried on the cable guide, wherein the power cables are separated from one another by a portion of the slider and the power cables cross in a location that remains substantially the same over a draw cycle of the bow.

21. An archery bow cable slider, comprising:
a base end extending along a first axis;
a free end extending along the direction of the first axis; and
a unitary body disposed between the base end and the free end, the body having a first slot and a second slot penetrating through the body;
wherein the first slot is independent of the second slot;
wherein the first slot extends along a second axis positioned substantially perpendicular to the first axis and directed toward the base end along at least a portion of its length before bending such that an outermost segment of the first slot nearest the base end runs along the direction of the first axis; and
wherein the second slot extends along a third axis positioned substantially perpendicular to the first axis and directed toward the base end for at least a portion of its length, the second slot overlapping the outermost segment of the first slot in the direction of the first axis.

22. The cable slider of claim 21, wherein the throughbore is complimentary to a cable guide.

23. An archery bow cable slider, comprising:
a base wall extending along an axis and having a forward end and a rearward end;

a forward wall extending in a direction transversely away from the base wall from a forward fixed end to a forward free end;

a rearward wall extending in a direction transversely away from the base wall from a rearward fixed end to a rearward free end and spaced axially apart from the forward wall;

an intermediate wall extending from a portion of the rearward wall at a location spaced transversely away from the base wall, and extending in a direction transversely away from the base wall from an intermediate fixed end to an intermediate free end, and spaced axially apart from the forward wall and rearward walls; and a throughbore extending through the free ends of the forward, rearward, and intermediate walls, wherein the base, forward, rearward, and intermediate walls establish a first slot having a laterally extending portion and an axially extending portion that extends substantially perpendicular to the laterally extending portion, and the rearward and intermediate walls establish a second slot that at least partially axially overlaps the first slot.

24. The cable slider of claim 23, wherein the first slot is substantially L-shaped.

* * * * *